US008016413B2

(12) United States Patent
Barnard et al.

(10) Patent No.: US 8,016,413 B2
(45) Date of Patent: Sep. 13, 2011

(54) HAND HELD PRINTER COLOR MISALIGNMENT CORRECTION

(75) Inventors: Karen Susan Barnard, Lexington, KY (US); Michael Anthony Marra, III, Lexington, KY (US); Barry Baxter Stout, Beverly, MA (US)

(73) Assignee: Lexmark International, Inc., Lexington, KY (US)

( * ) Notice: Subject to any disclaimer, the term of this patent is extended or adjusted under 35 U.S.C. 154(b) by 833 days.

(21) Appl. No.: 11/959,555

(22) Filed: Dec. 19, 2007

(65) Prior Publication Data

US 2009/0160894 A1 Jun. 25, 2009

(51) Int. Cl.
*B41J 3/36* (2006.01)

(52) U.S. Cl. ..... 347/109

(58) Field of Classification Search ..... 347/109
See application file for complete search history.

(56) References Cited

U.S. PATENT DOCUMENTS

2006/0050131 A1* 3/2006 Breton ..... 347/109
2007/0013745 A1* 1/2007 Kusunoki ..... 347/55
2007/0052745 A1* 3/2007 Izuo ..... 347/14

* cited by examiner

*Primary Examiner* — Laura Martin

(57) ABSTRACT

A method for correcting misalignment between a plurality of columns of color ink jetting nozzle arrays of a color printhead during printing with a hand held printer includes determining a misdirection angle of motion of the plurality of columns of color ink jetting nozzle arrays relative to a desired direction of motion of the hand operated printer; determining for each of the plurality of columns of color ink jetting nozzle arrays a respective usable nozzles subset to be used in printing a swath, based on the misdirection angle; determining an amount of shifting of at least one of the respective usable nozzles subsets to adjust for non-perpendicularity of the color ink jetting nozzle arrays relative to the desired direction of motion, based on the misdirection angle; and shifting the respective usable nozzles subset for a respective column based on the amount determined.

8 Claims, 7 Drawing Sheets

HAND HELD PRINTER COLOR MISALIGNMENT CORRECTION

BACKGROUND OF THE INVENTION

1. Field of the Invention

The present invention relates to hand held printers, and, more particularly, to a hand held printer with color misalignment correction.

2. Description of the Related Art

A hand held printer, also sometimes referred to as a hand-operated printer, is a printer that mounts a printhead and ink supply, which may be in the form of an ink jet printhead cartridge, wherein the printer itself is moved relative to the print medium, such as a sheet of paper, to position the printhead relative to the print medium. Thus, unlike a typical desktop printer, the hand held printer does not include a drive mechanism for physically positioning the printhead relative to the print medium, nor does a hand held printer include a media feed system for feeding a sheet of print media.

In a hand held printer, an optical encoder or another location-sensing device is used to provide position data for firing the printhead by sensing the relative motion of the hand held printer relative to the print medium. Thus, such a hand held printer is designed to print a single swath having a height corresponding to the height of the printhead. However, when using a hand held printer, there is a tendency to sweep the printer in a slightly curved arc rather than in a straight line.

In color printing, the different color nozzles are lined up in vertical columns. As one example, in the case of three colors, the three columns of nozzles may eject yellow, magenta, and cyan inks from the first, second, and third columns, respectively.

FIG. 1 illustrates one problem associated with attempting to print color using a hand held printer. FIG. 1 illustrates printing as a result of using a hand held printer having a color printhead 100 including a yellow column of nozzles 100-1, magenta column of nozzles 100-2, and cyan column of nozzles 100-3, and while trying to print a composite gray color 102, for example, with the color printhead 100 rotated or not perpendicular to the motion path 103. In this case, the color printhead 100 leaves a yellow line 104 and a red line 106 (composite yellow and magenta) at the top of each swath, and a blue line 108 (composite magenta and cyan) and a cyan line 110 at the bottom of each swath. The height of the lines corresponds to the tilt of color printhead 100. For example, a 45 degrees tilt of color printhead 100 with a two millimeter horizontal separation between the yellow column of nozzles 100-1 and the cyan column of nozzles 100-3 will cause a two millimeter vertical offset between the yellow column of nozzles 100-1 and the cyan column of nozzles 100-3.

Also, as illustrated in FIG. 2, while trying to print the composite gray color 102, for example, due the horizontal spacing of the yellow column of nozzles 100-1, magenta column of nozzles 100-2, and cyan column of nozzles 100-3, an abrupt stopping of the hand held printer 10 during the printing of a print swath may result in distinct vertical bands at the end of the swath. In the present example, the swath ends with a blue vertical band 112 (composite magenta and cyan) and a cyan vertical band 114 at the end of the swath.

What is needed in the art is a method for correcting misalignment between the different columns of color nozzles during color printing with a hand held printer.

SUMMARY OF THE INVENTION

The present invention provides a method for correcting misalignment between the different color nozzles during color printing with a hand held printer.

The terms "first" and "second" preceding an element name, e.g., first column, second column, etc. are used for identification purposes to distinguish between similar or related elements, and are not intended to necessarily imply order, nor are the terms "first" and "second" intended to preclude the inclusion of additional similar or related elements.

Also, as used herein, the terms "horizontal" and "vertical" corresponds to directions within or parallel to the plane of print medium, such as a sheet of paper, unless otherwise specified.

The invention, in one form thereof, is directed a method for automatically correcting misalignment between a plurality of columns of color ink jetting nozzle arrays of a color printhead during color printing with a hand held printer. The method includes determining a misdirection angle of motion of the plurality of columns of color ink jetting nozzle arrays relative to a desired direction of motion of the hand operated printer; determining for each of the plurality of columns of color ink jetting nozzle arrays a respective usable nozzles subset to be used in printing a swath, based on the misdirection angle; determining an amount of shifting of at least one of the respective usable nozzles subsets to adjust for non-perpendicularity of the color ink jetting nozzle arrays relative to the desired direction of motion, based on the misdirection angle; and shifting the respective usable nozzles subset for a respective column based on the amount determined.

The invention, in another form thereof, is directed to a method for automatically correcting misalignment between a plurality of columns of color ink jetting nozzle arrays of a color printhead during color printing with a hand held printer, wherein the plurality of columns of color ink jetting nozzle arrays consist of three columns of color ink jetting nozzle arrays including from left to right a first column spaced apart from a second column, and the second column spaced apart from a third column. The method includes, during a rightward scan of the color printhead, ceasing printing with the third column when the third column reaches a target point; continuing a hand-scanning of the color printhead in the rightward direction; ceasing printing with the second column when the second column reaches the target point; continuing the hand-scanning of the color printhead in the rightward direction; and ceasing printing with the first column when the first column reaches the target point.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 3:
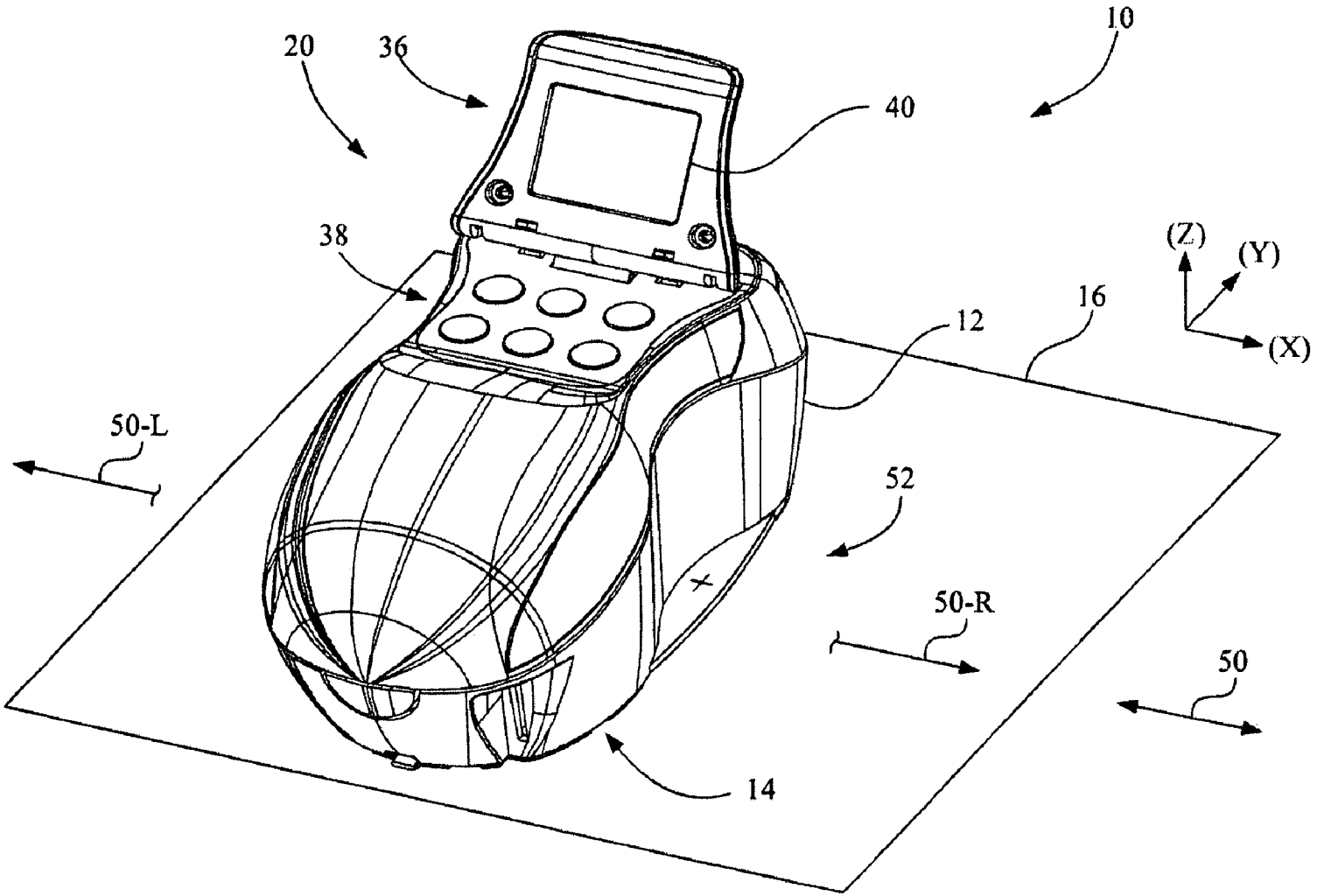
FIG. 3 is a perspective view of a hand held printer in accordance with an embodiment of the present invention.

Referring now to the drawings and particularly to FIG. 3, there is shown a perspective view of a hand held printer 10. Hand held printer 10 includes a body 12. Body 12 is configured with a surface 14, e.g., a smooth surface, that contacts a print medium 16, such as for example, a sheet of paper, transparency, card stock, fabric, hard surface, soft surface, etc. During operation, a user provides the motive force to provide movement of hand held printer 10 relative to print medium 16.

Figure 4:
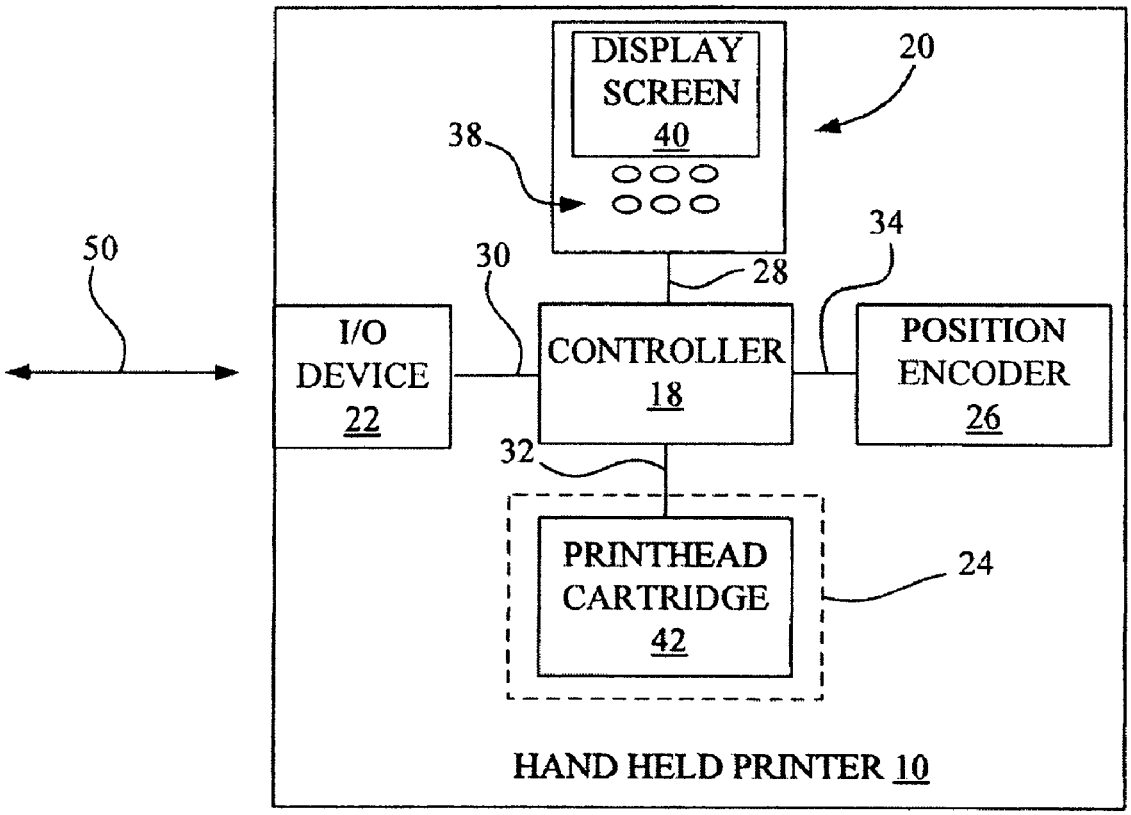
FIG. 4 is a general diagrammatic representation of the hand held printer of FIG. 3.

FIG. 4 is a general diagrammatic representation of hand held printer 10. Hand held printer 10 may be, for example, a hand held ink jet printer, and may include a controller 18, an operator panel 20, an input/output (I/O) device 22, a cartridge receptacle 24, and a position encoder 26. Each of controller 18, operator panel 20, I/O device 22, cartridge receptacle 24, and position encoder 26 is mounted to body 12.

Controller 18 includes a processor unit and associated memory, and may be formed as one or more Application Specific Integrated Circuits (ASIC). Controller 18 executes program instructions to perform data processing and formatting, facilitate device control, and/or facilitate device interaction with respect to a plurality of devices in communication with controller 18. Controller 18 is communicatively coupled to operator panel 20 via communications link 28. Controller 18 is communicatively coupled to I/O device 22 via communications link 30. Controller 18 is communicatively coupled to cartridge receptacle 24 via a communications link 32. Controller 18 is communicatively coupled to position encoder 26 via a communications link 34. As used herein, the term "communications link" generally refers to structure that facilitates electronic communication between components, and may operate using wired or wireless technology.

As shown in FIGS. 3 and 4, operator panel 20 includes a display device 36, coupled by hinges to body 12, and a plurality of control buttons 38. Display device 36 and control buttons 38 are communicatively coupled to controller 18 via communications link 28. Display device 36 includes a display screen 40, which may be, for example, a liquid crystal display (LCD) having, for example, a resolution (height×width) of 81×101 pixels. Control buttons 38 may include, for example, a POWER button, a PRINT, etc. Of course, the number of buttons and their associated function may depend on the actual configuration of the hand held printer and the applications for which the hand held printer may be used.

I/O device 22 may be configured in a variety of ways, depending on the source and/or destination of the communicated content. For example, I/O device 22 may be a wired or wireless communication device that provides a communications link to a host computer, or some other intelligent device, that may supply image data for printing by hand held printer 10. Alternatively, I/O device 22 may be a local source of image content, such as for example, a memory card reader and associated memory card.

Cartridge receptacle 24, for example, may be formed in body 12 and configured for receiving and mounting at least one printhead cartridge 42. Cartridge receptacle 24 holds a color printhead cartridge 42 in a fixed position relative to, i.e., is removably yet fixedly mounted to, hand held printer 10. Color printhead cartridge 42 is communicatively coupled to controller 18 via communications link 32.

Figure 5:
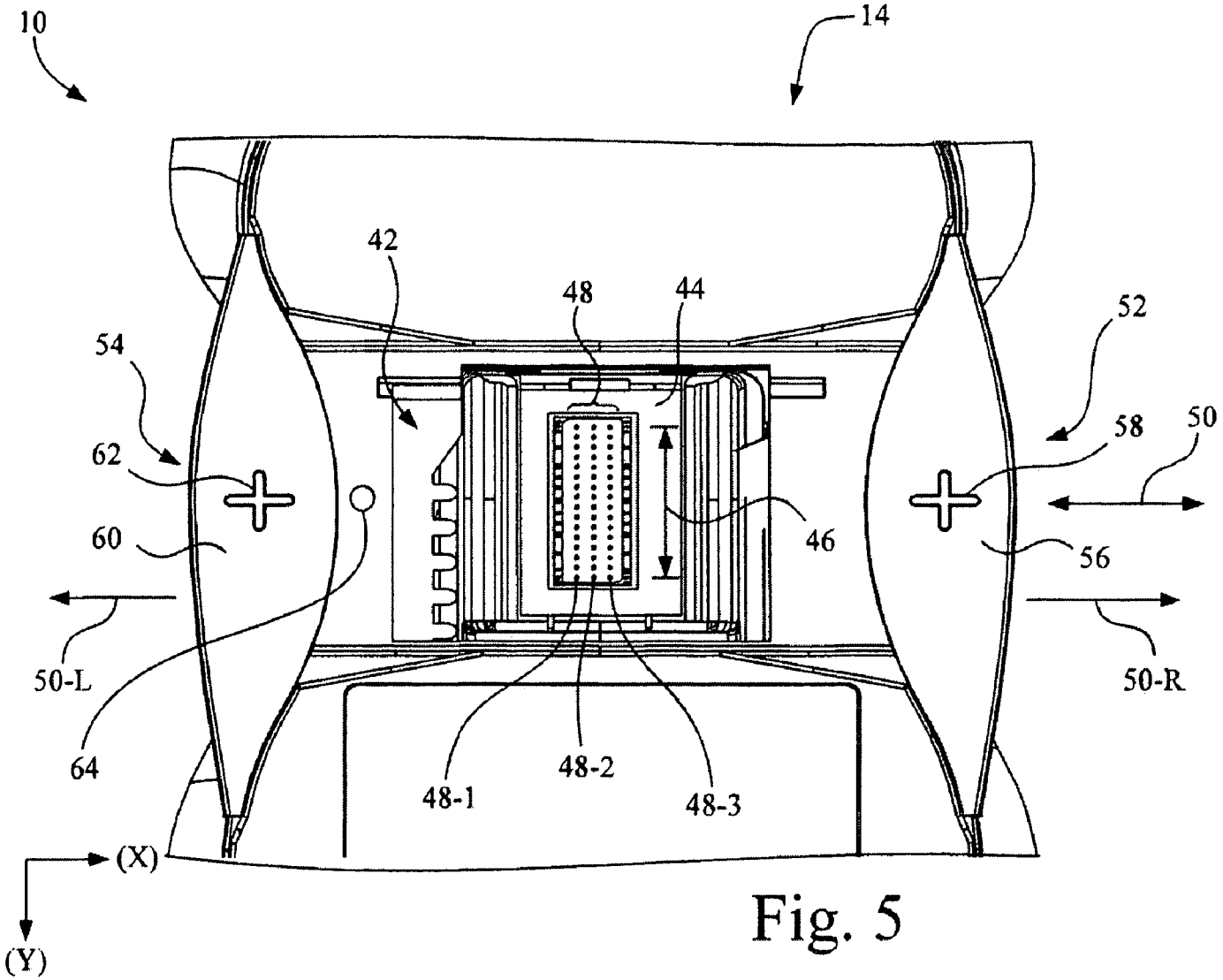
FIG. 5 is an enlarged bottom view of a portion of the hand held printer of FIG. 3.

As shown in the example of FIG. 5, color printhead cartridge 42 includes a color printhead 44 and a supply of ink (not shown). Color printhead 44 may, for example, have a printhead height 46 of 0.5 inches, as determined by the height of a plurality of ink jetting nozzle arrays 48 that are arranged in columns. In the present embodiment, ink jetting nozzle arrays 48 include a yellow nozzle array 48-1, a magenta nozzle array 48-2, and a cyan nozzle array 48-3.

Referring to FIGS. 3 and 5, the orientation of hand held printer 10 and color printhead 44 are depicted for convenience and ease of understanding by the X, Y and Z axes. Movement of the hand held printer 10 relative to print medium 16 may be in either direction along bi-directional travel direction 50, e.g., a horizontal path, which results in relative movement of color printhead cartridge 42 and color printhead 44 with respect to a printing surface of print medium 16. A rightward direction of bi-directional travel direction 50 is referred to herein as a desired direction of motion 50-R, and a leftward direction of bi-directional travel direction 50 is referred to herein as a desired direction of motion 50-L. The smooth surface 14 of body 12 contacts print medium 16 to provide the desired spacing between color printhead 44 and the printing surface of print medium 16.

In the present embodiment, as shown in FIG. 5, a target sight 52 is positioned to the right of color printhead cartridge 42 to facilitate alignment of a scan of hand held printer 10 during a manual scanning (i.e., a hand-scanning) of color printhead 44 in the desired direction of motion 50-R, e.g., a left-to-right direction. A target sight 54, which may be optional, is positioned to the left of printhead cartridge 42 to facilitate alignment of a scan of hand held printer 10 during a manual scanning (i.e., a hand-scanning) of color printhead 44 in the desired direction of motion 50-L, e.g., a right-to-left direction. In the example above, the use of the terms "left-to-right direction" and "right-to-left" assumes that the intended scan path is substantially horizontal. However, those skilled in the art will recognize that the scan path may be of any orientation, e.g., including vertical, diagonal or curved, with respect to the print media.

Target sight 52 has a corresponding transparent region 56 formed in body 12, and has a reticle 58 providing orientation aspects in two dimensions. In one embodiment, for example, reticle 58 may be a cross-shaped reticle providing orientation aspects in perpendicular directions. Target sight 54 has a corresponding transparent region 60 formed in body 12, and has a reticle 62 providing orientation aspects in two dimensions. For example, reticle 62 also may be a cross-shaped reticle providing orientation aspects in perpendicular directions. Reticles 58 and 62 are shown substantially vertically centered with respect to the height of color printhead 44. However, those skilled in the art will recognize that the vertical and horizontal locations of reticles 58 and 62 with respect to color printhead 44 may be changed, as desired, to accommodate, for example, different maximum swath spacings. For example, reticles 58 and 62 may be vertically aligned with the upper nozzles, or an upper nozzle section, of color printhead 44.

In the present embodiment, position encoder 26 is a two-dimensional sensor that collects two-dimensional position data, which may also sometimes be referred to herein as X-axis data and Y-axis data. Position encoder 26 may be implemented as a charge-coupled device (CCD) of 255×255 pixels having an associated lens 64 positioned on the underside of hand held printer 10, as shown in FIG. 3. Position encoder 26 sends the collected two-dimensional position data (e.g. X-axis and Y-axis data) to controller 18 via communications link 34. Controller 18 executes program instructions to process the two-dimensional position data generated by position encoder 26.

Figure 6:
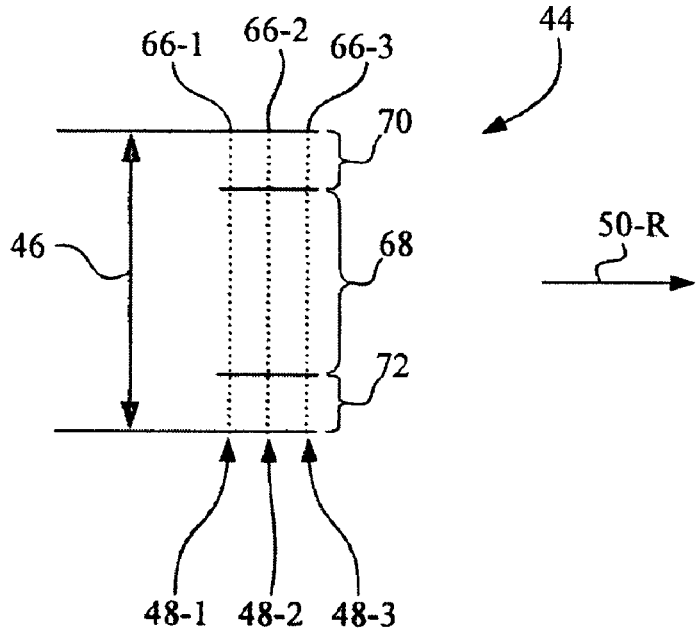
FIG. 6 is a schematic illustration of the color printhead of the hand held printer of FIG. 3, wherein the columns of ink jetting nozzle arrays are segmented into a central nozzle portion, an upper reserve nozzle portion, and a lower reserve nozzle portion.

Referring now to FIG. 6, there is shown a schematic illustration of color printhead 44 wherein ink jetting nozzle arrays 48-1, 48-2 and 48-3 are arranged in exemplary columns 66-1, 66-2, and 66-3, respectively. The height of columns 66-1, 66-2, and 66-3 from the uppermost nozzle to the lowermost nozzle defines printhead height 46. In accordance with an aspect of the present invention, each of columns 66-1, 66-2, and 66-3 having the plurality of ink jetting nozzle arrays 48-1, 48-2 and 48-3 is segmented into a central nozzle portion 68, an upper reserve nozzle portion 70, and a lower reserve nozzle portion 72.

The amount of each of reserve nozzle portions 70, 72 is set based on usability, as further described below, and may dynamically range, for example, from zero nozzles to 33 nozzles, or more if desired. Controller 18 may, for example, monitor the vertical misdirection of hand held printer 10 by the user and reduce or increase the number of reserved nozzles for each of reserve nozzle portions 70, 72.

Figure 7:
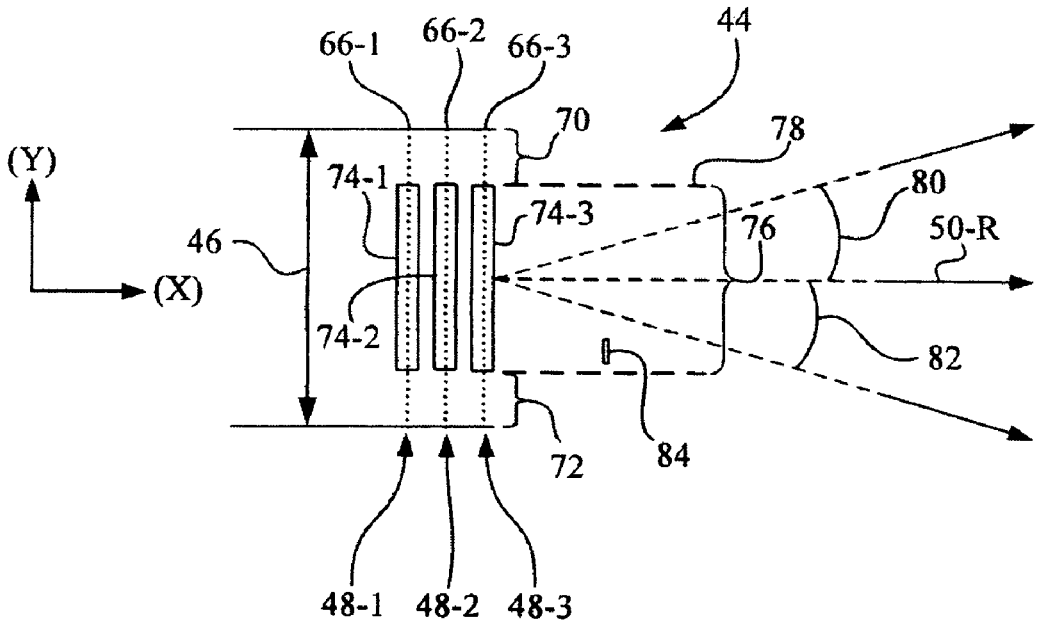
FIG. 7 is a schematic illustration of the color printhead of the hand held printer of FIG. 3, depicting usable nozzles subsets of the plurality of ink jetting nozzle arrays.

FIG. 7 illustrates the concept of usable nozzles and reserve nozzles, wherein a usable number of nozzles, i.e., a usable nozzles subset 74-1 of column 66-1, a usable nozzles subset 74-2 of column 66-2, and a usable nozzles subset 74-3 of column 66-3, may initially correspond to central nozzle portion 68 in each of ink jetting nozzle arrays 48-1, 48-2 and 48-3. Each of the usable nozzles subsets 74-1, 74-2, 74-3 represents a respective adjacent group of a known number of nozzles of each of yellow nozzle array 48-1, magenta nozzle array 48-2, and cyan nozzle array 48-3 that will be available for printing at a particular print location. However, the particular nozzles from the color ink jetting nozzle arrays 48-1, 48-2 and 48-3 respectively populating each of the usable nozzles subsets 74-1, 74-2, 74-3 may be changed, e.g., by shifting one or more of the usable nozzles subsets 74-1, 74-2, 74-3 into one of upper reserve nozzle portion 70 or lower reserve nozzle portion 72, to provide vertical color misalignment correction, as described in more detail below. Each of the usable nozzles subsets 74-1, 74-2, 74-3 defines a print swath height, i.e., image height, 76, (see FIG. 7) and the region traced by the usable nozzles subsets 74-1, 74-2, 74-3 is a print swath, e.g., print swath 78.

Figure 8:
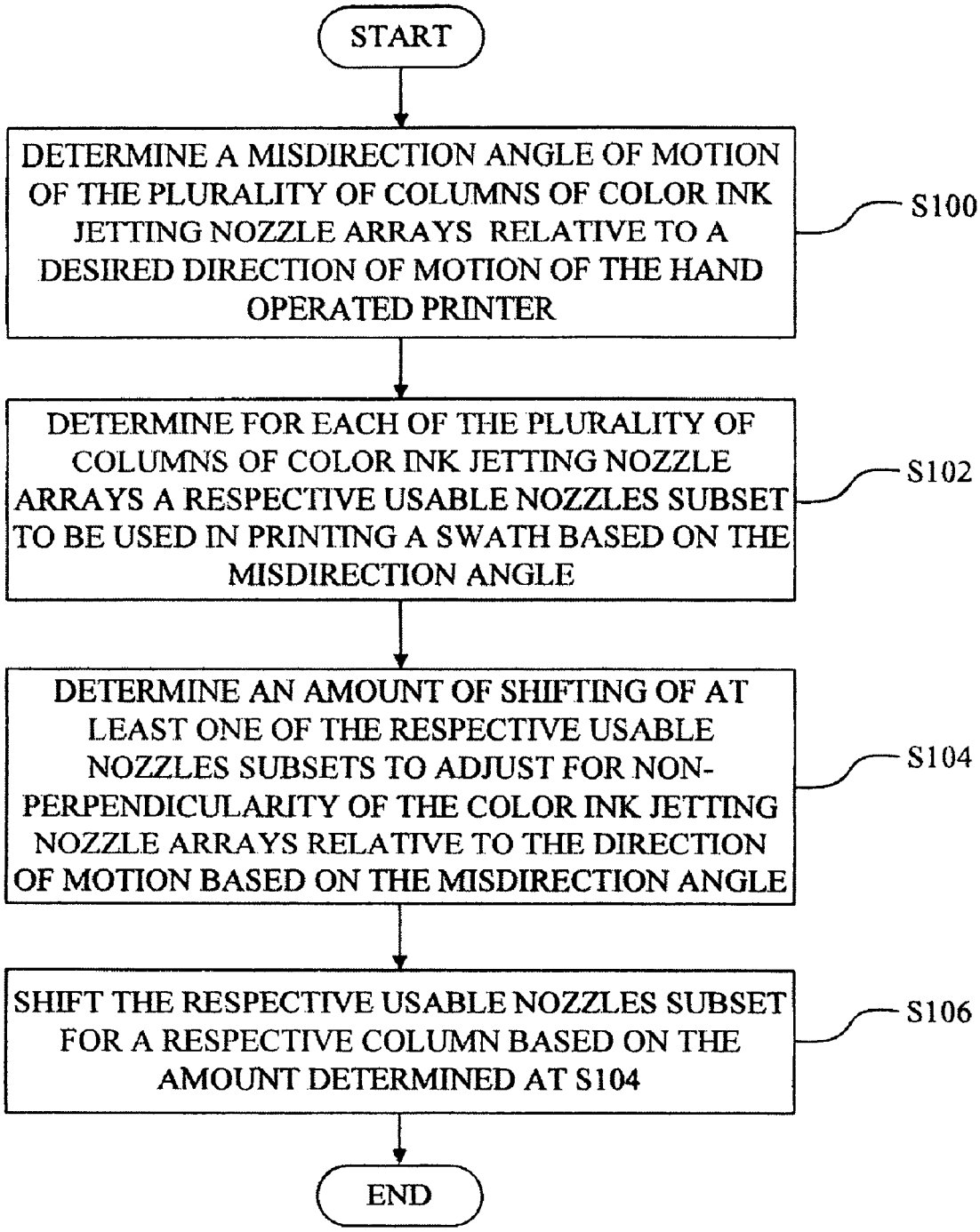
FIG. 8 is a flowchart of a method for color misalignment correction in a hand held printer, according to an embodiment of the present invention.

FIG. 8 is a flowchart of a method for automatically correcting misalignment between the different columns 66-1, 66-2, and 66-3 of color ink jetting nozzle arrays 48-1, 48-2 and 48-3 due to non-perpendicularity of color ink jetting nozzle arrays 48-1, 48-2 and 48-3 relative to a desired direction of motion (e.g., 50-R or 50-L) during color printing with a hand held printer, such as hand held printer 10. The method may be implemented by controller 18 of hand held printer 10 by executing program instructions corresponding to the various method acts.

At act S100, a misdirection angle of motion of columns 66-1, 66-2, and 66-3 of color ink jetting nozzle arrays 48-1, 48-2 and 48-3 relative to the desired (e.g., X-axis) direction of motion (e.g., 50-R or 50-L) is determined.

The misdirection angle of motion (e.g., 80 or 82) relative to the desired direction of motion 50-R is illustrated in FIG. 7. As shown, an angle of motion (misdirection angle) 80 results in a positive Y-axis movement of color ink jetting nozzle arrays 48-1, 48-2 and 48-3, and an angle of motion (misdirection angle) 82 results in a negative Y-axis movement of color ink jetting nozzle arrays 48-1, 48-2 and 48-3.

One method for determining the angle of motion is performed by processing the X and Y signals provided by position encoder 26. For example, the angle of motion 80 or 82 may be determined as follows:

$$\text{angle of motion(i.e., misdirection angle)} = \tan^{-1}(dy/dx) \qquad \text{Equation 1}$$

wherein:

dx is distance traveled in a pre-specified time period along the X-axis, i.e., in the desired direction of motion 50-R or 50-L, perpendicular to color ink jetting nozzle arrays 48-1, 48-2 and 48-3; and dy is distance traveled in a pre-specified time period along the Y-axis, in a direction parallel to the vertical extent of color ink jetting nozzle arrays 48-1, 48-2 and 48-3.

The algorithm above provides a very good estimate of the misdirection angle of motion when there is little to no variation in the trajectory, as well as in the presence of slowly varying yaw.

At act S102, a respective usable nozzles subset to be used in printing a swath is determined for each of the plurality of columns 66-1, 66-2, 66-3 of color ink jetting nozzle arrays 48-1, 48-2, 48-3 based on the misdirection angle (e.g., 80 or 82). For example, the usable nozzles from each of yellow nozzle array 48-1, magenta nozzle array 48-2 and cyan nozzle array 48-3 to be used in printing a swath, e.g., print swath 78, is determined dynamically based on the output of position encoder 26. However, those skilled in the art will recognize that accuracy may be increased by using multiple position encoders.

Table 1 below shows the relationship between the misdirection angle, or yaw, (e.g., angle 80 or 82) and vertical misalignment. It is assumed in Table 1 that the space between the first column of nozzles 66-1 (e.g., yellow nozzle array 48-1) and the third column of nozzles 66-3 (e.g., cyan nozzle array 48-3) is 2.0 millimeters (mm); the total number of nozzles per column is 312, and the nozzle resolution (vertical) is 600 dots per inch (dpi).

TABLE 1

Determining Printhead Shift from Misdirection Angle

| | Vertical Misalignment | | | | Printhead Nozzles | |
|---|---|---|---|---|---|---|
| Misdirection (yaw) Angle Degrees | In Milli-meters | In Micro-meters | In 1/1200's of an inch | In 1/150's of an inch | Usable Nozzles | Amount of Vertical Shift |
| 0 | 0 | 0 | 0 | 0 | 312 | 0 |
| 5 | 0.175 | 175 | 8 | 1 | 308 | 2 |
| 10 | 0.353 | 353 | 17 | 2 | 304 | 4 |
| 15 | 0.536 | 536 | 25 | 3 | 300 | 6 |
| 20 | 0.728 | 728 | 34 | 4 | 294 | 9 |
| 25 | 0.933 | 933 | 44 | 6 | 290 | 11 |
| 30 | 1.155 | 1155 | 55 | 7 | 284 | 14 |
| 35 | 1.400 | 1400 | 66 | 8 | 278 | 17 |
| 40 | 1.678 | 1678 | 79 | 10 | 272 | 20 |
| 45 | 2.000 | 2000 | 94 | 12 | 264 | 24 |

Table 1 may be populated, in part, based on the following equations:

$$\text{Vertical shift}=\text{round}[(1\text{ mm})*\tan(\text{misdirection angle})/(25.4\text{ mm/inch})*(600\text{ nozzles/inch})] \quad \text{Equation 2}$$

$$\text{Usable Nozzles}=312-2*\text{Vertical Shift}. \quad \text{Equation 3}$$

The contents of Table 1 may be implemented as a lookup table stored in memory of controller 18, which may be accessed based on the misdirection angle calculated, for example, in Equation 1. Alternatively, controller 18 may perform the calculations of Equations 1, 2, and 3 in real time.

As illustrated in Table 1, a number of usable nozzles and an amount of vertical shift (in number of nozzles) are dependent on the amount of vertical (Y-axis) misalignment. If it is assumed that a user wants a fax quality print, for example, then an error of as much as 2/150 of an inch may be acceptable. In this example, then the color printhead 44 can tilt up to 5 degrees before the color shift is noticeable. Through experimentation, one is able to identify the angle range of the misdirection angle that will cause noticeable misalignment of the columns 66-1, 66-2, 66-3 of color printhead 44.

As an example with respect to acts S102 and S104, in order to eliminate the defect associated with non-perpendicular motion of color printhead 44, different sets of nozzles may be used on each of yellow nozzle array 48-1, magenta nozzle array 48-2, and cyan nozzle array 48-3.

For example, referring again to FIG. 7, in the case of a positive misdirection angle 80 in rightward direction of motion 50-R and the color order shown, the usable nozzles of yellow nozzle array 48-1 will be shifted into upper reserve nozzle portion 70, the usable nozzles of magenta nozzle array 48-2 may be unshifted (or shifted by a lesser amount), and the usable nozzles of cyan nozzle array 48-3 may be shifted into the lower reserve nozzle portion 72.

In the case of a negative misdirection angle 82 in rightward direction of motion 50-R and the color order shown, the usable nozzles of yellow nozzle array 48-1 will be shifted into lower reserve nozzle portion 72, the usable nozzles of magenta nozzle array 48-2 may be unshifted (or shifted by a lesser amount), and the usable nozzles of cyan nozzle array 48-3 may be shifted into the upper reserve nozzle portion 70.

As another example, referring also to FIG. 5, in the case of a positive misdirection angle 80 in leftward direction of motion 50-L and the color order shown, the usable nozzles of yellow nozzle array 48-1 will be shifted into lower reserve nozzle portion 72, the usable nozzles of magenta nozzle array 48-2 may be unshifted (or shifted by a lesser amount), and the usable nozzles of cyan nozzle array 48-3 may be shifted into the upper reserve nozzle portion 70.

In the case of a negative misdirection angle 82 in leftward direction of motion 50-L, and the color order shown, the usable nozzles of yellow nozzle array 48-1 will be shifted into upper reserve nozzle portion 70, the usable nozzles of magenta nozzle array 48-2 may be unshifted (or shifted by a lesser amount), and the usable nozzles of cyan nozzle array 48-3 may be shifted into the lower reserve nozzle portion 72.

As a more specific example, with reference to Table 1, if a maximum angle of 30 degrees is assumed, and the adjacent color arrays 48-1, 48-2 and 48-3 are spaced by 1 mm apart, then 28 nozzles will be reserved (assuming 600 dpi). On a 312 nozzle printhead, this leaves a usable swath of 284 nozzles (about 12 mm). For the scenario described above, the center 284 nozzles of magenta nozzle array 48-2 would be used, and cyan (C) nozzle array 48-3 and yellow (Y) nozzle array 48-1 would be calculated as follows:

$$\text{First } C \text{ nozzle used}=\text{round}(23.62(\text{nozzles/mm})*(\tan(30)-\tan(\text{misdirection angle})); \text{ and} \quad \text{Equation 4}$$

$$\text{First } Y \text{ nozzle used}=\text{round}(23.62(\text{nozzles/mm})*(\tan(30)+\tan(\text{misdirection angle})). \quad \text{Equation 5}$$

In the case of changing trajectory during printing, the location printed with the leading color (e.g., cyan when printing in direction 50-R, or yellow when printing in direction 50-L in the examples above) is tracked, and the 2 trailing colors nozzle sets are adjusted. Optionally, a rough prediction of which nozzles on the leading color are optimal for the expected trajectory may be determined, e.g., empirically.

For additional control, a more advanced algorithm for calculating the active nozzle region is to figure out how many nozzles will overlap between all three columns. Table 1 also shows the number of usable nozzles or the maximum overlap region of nozzles. For instance, if the angle of rotation is 30 degrees, then the effective print swath can only be 288 nozzles high or 12 mm. Assuming that magenta is the middle color, this leaves 12 un-used nozzles at the top and bottom of the nozzle column or (312−288)/2. Likewise, the 2 colors on either side of magenta will have 12 un-used nozzles at each of the top or bottom of the column depending on if the rotation is to the right or left. This calculation shrinks the printable area from the original 312 nozzles to something smaller depending on the angle. For clarification, the actual printable swath will not scale in size but be cropped where the unprintable part of the swath is marked as unprinted in print scheduling table. Effectively, the user is just printing with a slightly smaller print head when printing at an angle.

At act S104, an amount of shifting of at least one of the respective usable nozzles subsets (e.g., 74-1, 74-2, 74-3) is determined, e.g., from Table 1 and/or Equation 2, to adjust for non-perpendicularity of the color ink jetting nozzle arrays 48-1, 48-2, 48-3 relative to the direction of motion (e.g., 50-R or 50-L) based on the misdirection angle. For example, from Table 1, if the misdirection angle is 10 degrees, then the amount of shifting is ±4 nozzles, with 8 nozzles held in reserve.

At act S106, the respective usable nozzles subset for a respective column is shifted based on the amount of shifting determined at act S104. In other words, the number of usable nozzles, i.e., the usable nozzles subsets, 74-1, 74-2, 74-3 of columns 66-1, 66-2, and 66-3 of color ink jetting nozzle arrays 48-1, 48-2 and 48-3 is shifted based on the determined amount to adjust for non-perpendicularity of color ink jetting nozzle arrays 48-1, 48-2 and 48-3 relative to a direction of motion (e.g., 50-R or 50-L), thereby adjusting for misalignment between the colors.

The shifting is performed dynamically as hand held printer 10 is hand-scanned in the desired direction of motion (e.g., 50-R or 50-L). Acts S100-S106 may be repeated during a scan at a predetermined sample rate based on distance or time, as desired.

Once the number usable nozzles for each of color ink jetting nozzle arrays 48-1, 48-2 and 48-3 has been identified at act S102, the determining of the shift amount and the shifting of acts S104 and S106 may be accomplished, for example, by either shifting the data to the designated nozzles dynamically during the printing of a print swath, or by formatting the data in thin slices that can change with horizontal (X-axis) print position.

For example, hand held printer 10 has functionality to individually address nozzle firing of each of color ink jetting nozzle arrays 48-1, 48-2 and 48-3, which facilitates controller 18 in being able to shift one or more of the usable nozzles subsets 74-1, 74-2, and/or 74-3, i.e., the firing nozzles, of the plurality of ink jetting nozzles 48-1, 48-2, 48-3 in real time. Alternatively, the shifting may be effected, for example, by shifting the firing nozzles in the formatter function of controller 18. As another alternative, an external multiplexer component under the control of controller 18 may act as external switcher and shift the usable nozzles subsets 74-1, 74-2, 74-3, i.e., the firing nozzles, of the plurality of color ink jetting nozzle arrays 48-1, 48-2 and 48-3.

Figure 1:
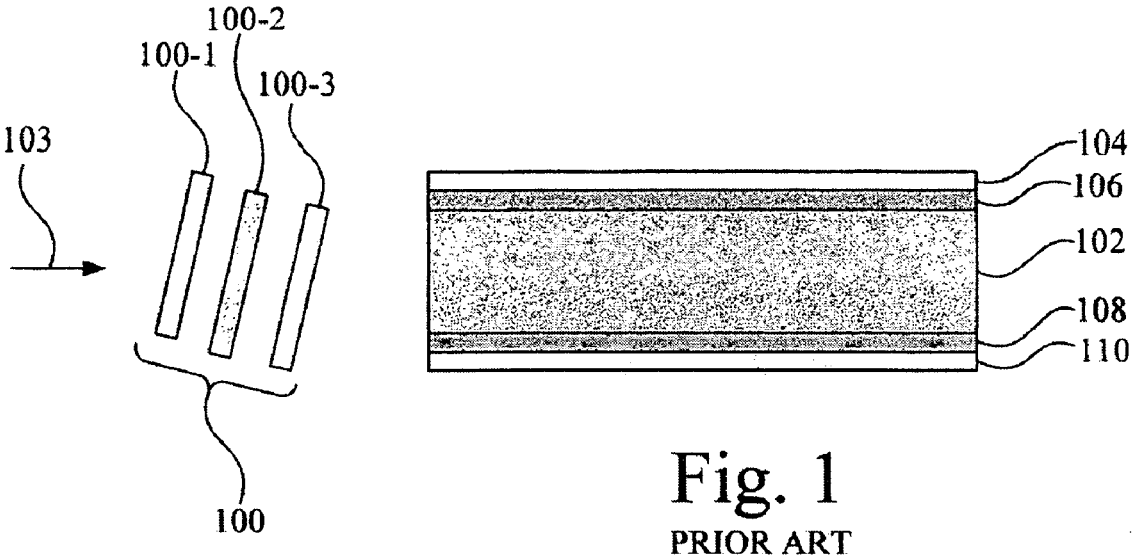
Fig. 1 PRIOR ART
FIG. 1 illustrates one form of color misalignment associated with attempting to print color using a hand held printer.
Figure 2:
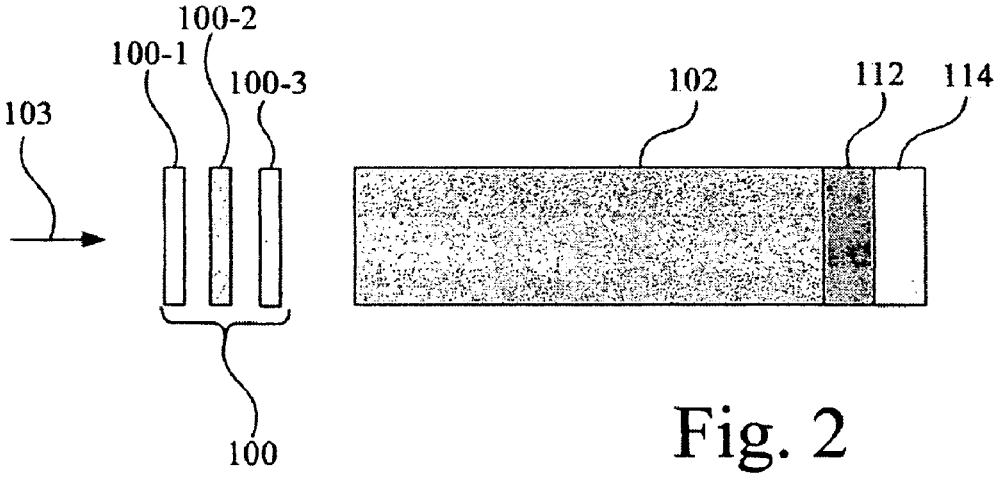
Fig. 2 PRIOR ART
FIG. 2 illustrates another form of color misalignment associated with attempting to print color using a hand held printer.
Figure 9:
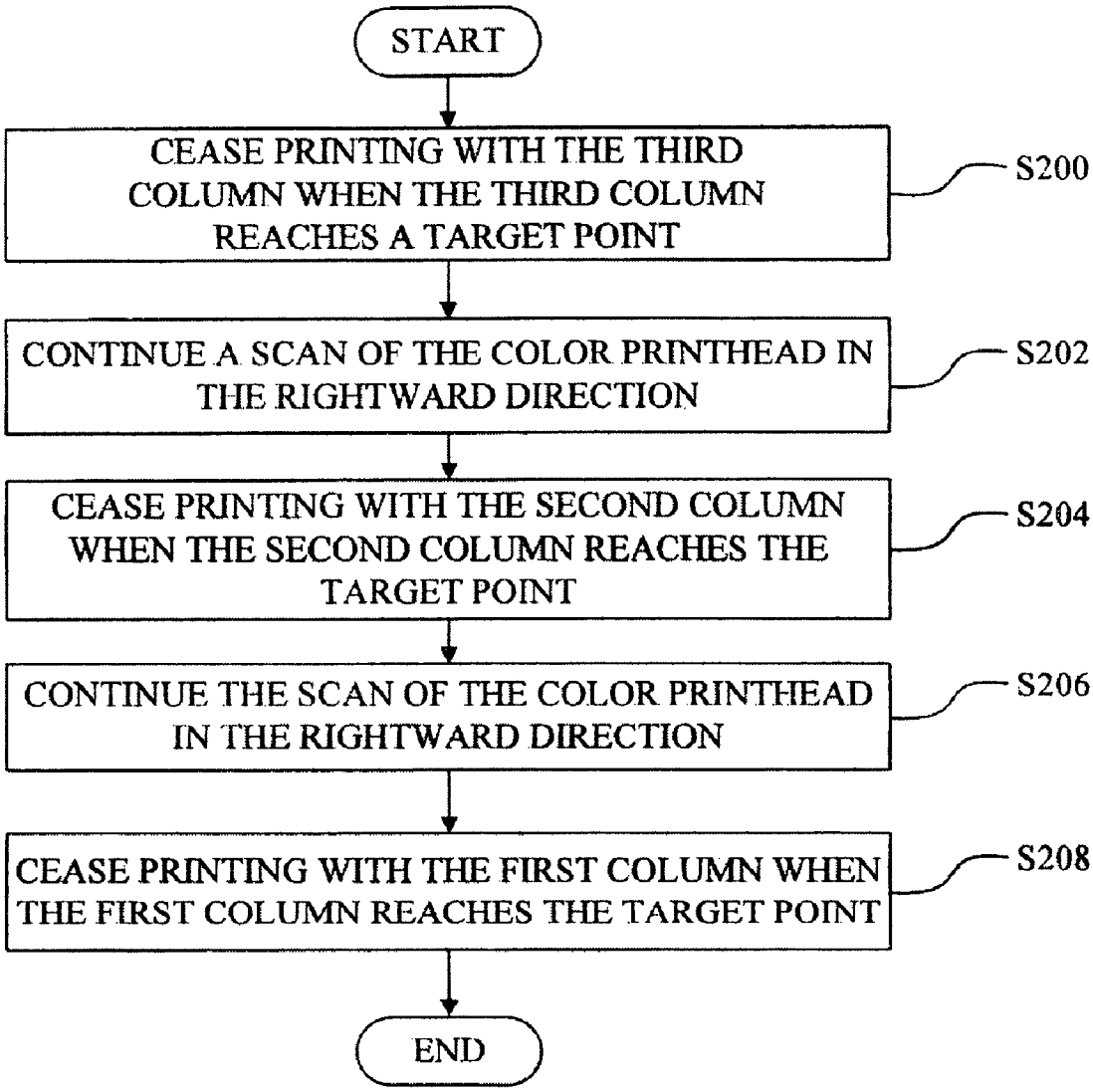
FIG. 9 is a flowchart of a method to correct for color misalignment that may occur, for example, at an end of a print swath.

Supplemental to the method described above, as shown in the flowchart of FIG. 9, further acts may be performed to correct for end-of-swath color misalignment, which was illustrated in FIG. 2. Recall that color printhead 44 has three nozzle columns 66-1, 66-2, 66-3 that may be spaced, for example, roughly one millimeter apart. The method will be described by example assuming a rightward (left to right) scan of hand held printer 10, and in turn, a left to right scan of columns 66-1, 66-2 and 66-3 of color ink jetting nozzle arrays 48-1, 48-2 and 48-3 of color printhead 44 during color printing.

At act S200, with reference to FIG. 7, printing with column 66-3 is ceased when column 66-3 reaches a target point 84.

At act S202, a scan of color printhead 44 in the rightward direction is continued.

At act S204, printing with column 66-2 is ceased when column 66-2 reaches target point 84.

At act S206, the scan of color printhead 44 in the rightward direction is continued.

At act S208, printing with column 66-1 is ceased when column 66-1 reaches the target point.

In accordance with the present invention, as the first column reaches the target point 84, e.g., end of the swath where printing should cease, the columns of nozzles are sequentially shut down as the motion of hand held printer 10 continues along bi-directional travel direction 50 so that each of the nozzle columns 66-1, 66-2, 66-3 ceases printing at the same target point 84 on the page.

As a more specific example illustrating the method of acts S200-S208, assuming a rightward direction of motion 50-R, cyan column 66-3 will reach the target point 84 first and will shut off. However, the next column (magenta column 66-2) does not shut off until hand held printer 10, and in turn color printhead 44, has moved an additional one millimeter in direction of motion 50-R beyond when the cyan column 66-3 shuts off. Then, the next column (yellow column 66-1) does not shut off until after the print head travels two millimeters beyond when the cyan column 66-3 shuts off. This keeps all the nozzles ending their firing sequence on the same location on the page.

When printing in the reverse direction, e.g., direction of motion 50-L, yellow column 66-1 will reach the target point first and will shut off. The next column (magenta column 66-2) does not shut off until hand held printer 10, and in turn color printhead 44, has moved an additional one millimeter in direction of motion 50-L beyond when yellow column 66-1 shuts off. Then, the next column (cyan column 66-3) does not shut off until after printhead 44 travels two millimeters beyond when yellow column 66-1 shuts off.

Due to the relatively slow nature of the handheld printer 10 especially during the end of a move, the input to the shut down algorithm is position based rather than time based. The algorithm simply observes the distance traveled past when the user signaled to turn "OFF" printing (e.g. by pressing one of control buttons 38) and correlates this to distance between the respective nozzle columns. Stated in another way, the turning off of the nozzle columns is based on the user's movement, and not the pre-formatted page.

In the case of the two dimensional printing, the user should take large sweeps past the edge of the print area so printhead 44 can cover the entire region. However, a user may either prematurely stop the movement of hand held printer 10, or change direction too quickly before reaching the end of the print margin. For multi-color printing, this produces color fringes. In this case, an algorithm may optionally be implemented that detects a drastic deceleration of printhead 44 after the end-of-print button of control buttons 38 has been pressed and tries to predict when the user only has 2 mm of travel left before hand held printer 10 comes to a stop. This is the required distance to initiate the turn off sequence mentioned above. This allows the swath not to end with a color fringe or print defect. In the case where a user purposely prints partial swaths for artistic purposes, the algorithm reduces the color fringe as well.

In the unlikely case according to usage tests that the user stops hand held printer 10 and then restarts hand held printer 10 in the same direction without turning around, the correction algorithm leaves a printed gap since at some point nozzle columns are turned off to properly overlap them. This is not a problem with two dimensional printing as the user can easily fill in this void.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for automatically correcting misalignment between a plurality of columns of color ink jetting nozzle arrays of a color printhead during color printing with a hand held printer, comprising:

determining a misdirection angle of motion of said plurality of columns of color ink jetting nozzle arrays relative to a desired direction of motion of said hand operated printer;

determining for each of said plurality of columns of color ink jetting nozzle arrays a respective usable nozzles subset in a central nozzle portion of the nozzle arrays to be used in printing a swath and making unavailable for imaging during the color printing a plurality of reserve nozzles outside the central nozzle portion of the nozzle arrays, based on said misdirection angle;

determining an amount of shifting of at least one of said respective usable nozzles subsets to adjust for non-perpendicularity of said color ink jetting nozzle arrays relative to said desired direction of motion, based on said misdirection angle; and shifting said respective usable nozzles subset for a respective column based on said amount determined, the shifting including allowing present imaging from at least one nozzle of the plurality of reserve nozzles earlier said made unavailable for imaging during the color printing and making unavailable for the present imaging at least one nozzle of the respectable usable nozzle subsets.

2. The method of claim 1, wherein said shifting is performed dynamically as said hand held printer is hand-scanned in said desired direction of motion.

3. The method of claim 1, wherein said plurality of columns of color ink jetting nozzle arrays consist of three columns of color ink jetting nozzle arrays including from left to right a first column, a second column and a third column, and therein during a rightward motion of said color printhead, when said misdirection angle is positive said respective usable nozzles subset for said first column is shifted oppositely to said third column.

4. The method of claim 3, wherein said second column is not shifted.

5. The method of claim 3, wherein said first column is a yellow ink jetting nozzle array, said second column is a magenta ink jetting nozzle array, and said third column is a cyan ink jetting nozzle array.

6. The method of claim 1, wherein said plurality of columns of color ink jetting nozzle arrays consist of three columns of color ink jetting nozzle arrays including from left to right a first column spaced apart from a second column, and said second column spaced apart from a third column, said method further comprising during a rightward scan of said color printhead:

ceasing printing with said third column when said third column reaches a target point;

continuing a hand-scanning of said color printhead in said rightward direction;

ceasing printing with said second column when said second column reaches said target point;

continuing said hand-scanning of said color printhead in said rightward direction;

ceasing printing with said first column when said first column reaches said target point.

7. The method of claim 6, wherein said first column is a yellow ink jetting nozzle array, said second column is a magenta ink jetting nozzle array, and said third column is a cyan ink jetting nozzle array.

8. The method of claim 1, wherein said plurality of columns of color ink jetting nozzle arrays consist of three columns of color ink jetting nozzle arrays including from left to right a first column spaced apart from a second column, and said second column spaced apart from a third column, said method further comprising during a leftward scan of said color printhead:

ceasing printing with said first column when said first column reaches a target point;

continuing a hand-scanning of said color printhead in said leftward direction;

ceasing printing with said second column when said second column reaches said target point;

continuing said hand-scanning of said color printhead in said leftward direction; and ceasing printing with said third column when said third column reaches said target point.

* * * * *